US011341941B2

(12) United States Patent
Spinelli

(10) Patent No.: US 11,341,941 B2
(45) Date of Patent: May 24, 2022

(54) BASS DRUM SPUR SYSTEM

(71) Applicant: John Spinelli, Pinellas Park, FL (US)

(72) Inventor: John Spinelli, Pinellas Park, FL (US)

( * ) Notice: Subject to any disclaimer, the term of this patent is extended or adjusted under 35 U.S.C. 154(b) by 0 days.

(21) Appl. No.: 17/203,032

(22) Filed: Mar. 16, 2021

(65) Prior Publication Data

US 2021/0287638 A1 Sep. 16, 2021

Related U.S. Application Data

(60) Provisional application No. 62/990,076, filed on Mar. 16, 2020.

(51) Int. Cl.
*G10D 13/02* (2020.01)
*G10D 13/10* (2020.01)

(52) U.S. Cl.
CPC ..... *G10D 13/28* (2020.02); *G10D 13/02* (2013.01)

(58) Field of Classification Search
CPC ..... G10D 13/28; G10D 13/02
See application file for complete search history.

(56) References Cited

U.S. PATENT DOCUMENTS 5,408,913 A * 4/1995 Hoshino ..... G10D 13/28 84/421
6,307,135 B1 * 10/2001 Hoshino ..... G10D 13/02 84/411 R
6,977,332 B2 * 12/2005 Liao ..... G10D 13/28 84/421
7,834,259 B2 * 11/2010 Jeffries ..... G10D 13/02 248/404
9,024,164 B1 * 5/2015 Keely ..... G10D 13/28 84/421
9,093,051 B2 * 7/2015 Sato ..... G10D 13/065
9,217,533 B2 * 12/2015 Mori ..... F16F 15/08
9,792,888 B1 * 10/2017 Allen ..... G10D 13/28
11,004,432 B1 * 5/2021 Chen ..... G10D 13/22
2009/0255394 A1 * 10/2009 Jeffries ..... G10D 13/02 84/421
2011/0023687 A1 * 2/2011 Jeffries ..... G10D 13/02 84/421
2021/0287638 A1 * 9/2021 Spinelli ..... G10D 13/02

* cited by examiner

*Primary Examiner* — Robert W Horn
(74) *Attorney, Agent, or Firm* — Lewellyn Law, PLLC; Stephen Lewellyn

(57) ABSTRACT

A bass drum spur system has a pivot assembly and a spur leg assembly. The pivot assembly has a spur hub removably attachable to a rim of a drum and a hub cover attached to the spur hub. The hub cover has a passageway and a circumferential slot formed through a sidewall of the passageway. The circumferential slot has first and second notches at respective opposite ends of the slot. A release button is axially slidable within the passageway of the hub cover and a spring is disposed in the passageway and biases the release button in a direction away from the spur hub. The spur leg assembly has a post fixedly attached to the release button for movement therewith, wherein the post is movable between engagement with the first notch and the second notch by pressing the release button in a direction toward the spur hub and rotating the post along the circumferential slot.

7 Claims, 3 Drawing Sheets

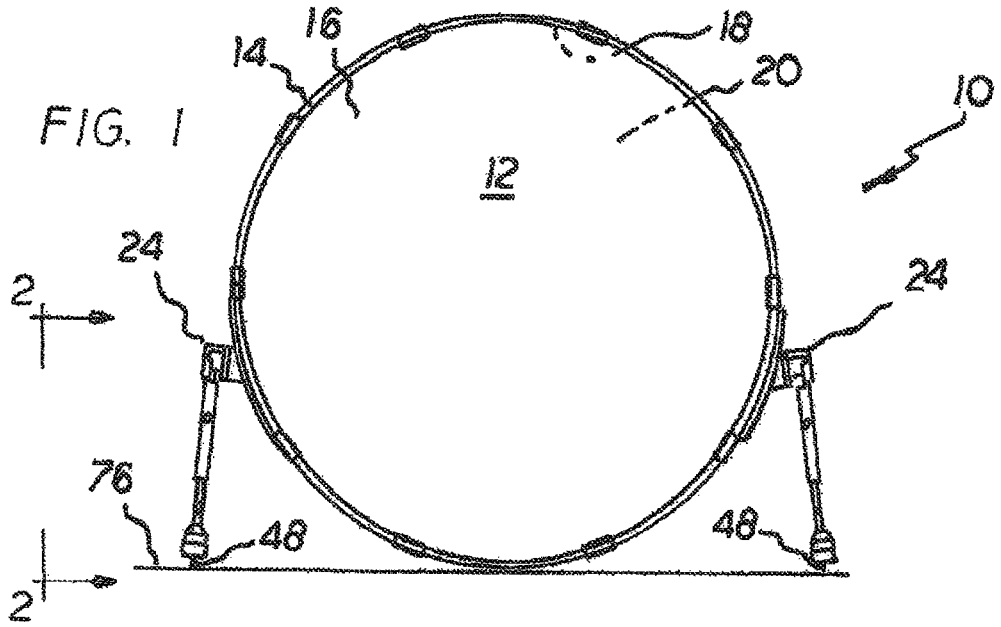
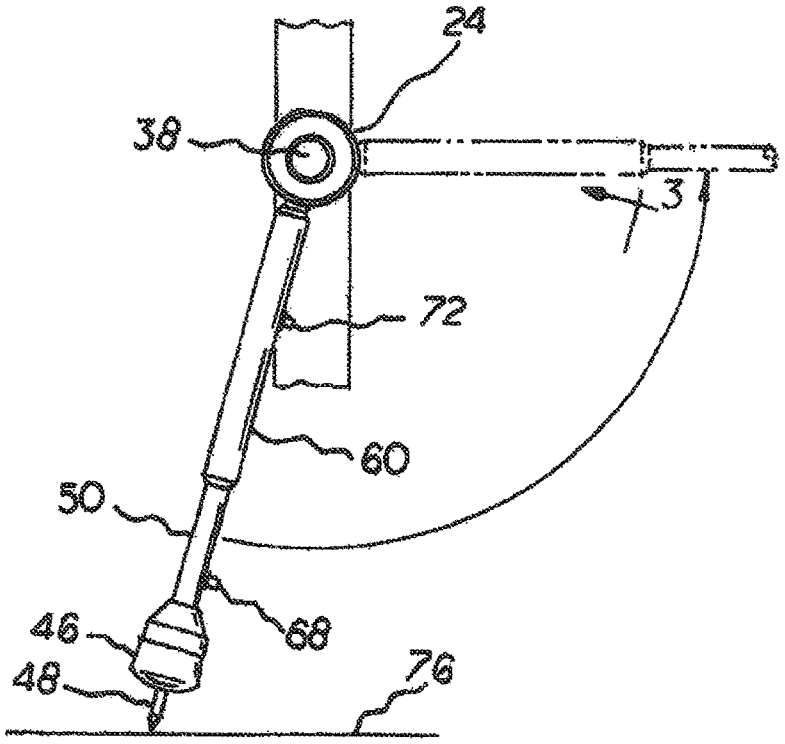
FIG. 2 3

BASS DRUM SPUR SYSTEM

CROSS-REFERENCE TO RELATED APPLICATIONS

This application claims the benefit of U.S. Provisional Patent Application Ser. No. 62/990,076, filed Mar. 16, 2020, the entirety of which is incorporated herein by reference.

FIELD OF THE INVENTION

The present invention relates to a bass drum spur system, and more particularly, pertains to fixedly positioning a bass drum during use and for facilitating the movement of such bass drum.

BACKGROUND OF THE INVENTION

The use of drum supports is known in the prior art. More specifically, drum supports previously devised and utilized for the purpose of supporting drums are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, do not describe a bass drum spur system that allows fixedly positioning a bass drum during use and for facilitating the movement of such bass drum.

In this respect the bass drum spur system according to the present invention substantially departs from the conventional concepts and designs of the prior art, and in doing so provides an apparatus primarily developed for the purpose of fixedly positioning a base drum during use and for facilitating movement of such drum.

Therefore, it can be appreciated that there exists a continuing need for a new and improved bass drum spur system which can be used for fixedly positioning a bass drum during use and for facilitating its movement. In this regard, the present invention substantially fulfills this need.

SUMMARY OF THE INVENTION

In view of the disadvantages inherent in the known types of drum supports now present in the prior art, the present invention provides an improved bass drum spur system. As such, the general purpose of the present invention, which will be described subsequently in greater detail, is to provide a new and improved bass drum spur system and method which has all the advantages of the prior art and none of the disadvantages.

In this respect, before explaining at least one embodiment of the invention in detail, it is to be understood that the invention is not limited in its application to the details of construction and to the arrangements of the components set forth in the following description or illustrated in the drawings.

In general, in one aspect, a bass drum spur system is provided. The system has a pivot assembly and a spur leg assembly. The pivot assembly has a spur hub removably attachable to a rim of a drum and a hub cover attached to the spur hub. The hub cover has a passageway and a circumferential slot formed through a sidewall of the passageway. The circumferential slot has first and second notches at respective opposite ends of the slot. A release button is axially slidable within the passageway of the hub cover and a spring is disposed in the passageway and biases the release button in a direction away from the spur hub. The spur leg assembly has a post fixedly attached to the release button for movement therewith, wherein the post is movable between engagement with the first notch and the second notch by pressing the release button in a direction toward the spur hub and rotating the post along the circumferential slot. And further wherein the spur leg assembly further has a foot for engagement with a ground surface when the post is disposed in the first semi-cylindrical notch.

The invention is capable of other embodiments and of being practiced and carried out in various ways. Also, it is to be understood that the phraseology and terminology employed herein are for the purpose of descriptions and should not be regarding as limiting.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings:

FIG. 1 is a front elevational view of a bass drum spur system constructed in accordance with the principle of the present invention;

FIG. 2 is a side elevational view taken at line 2-2 of FIG. 1;

DETAILED DESCRIPTION OF THE INVENTION

Figure 3:
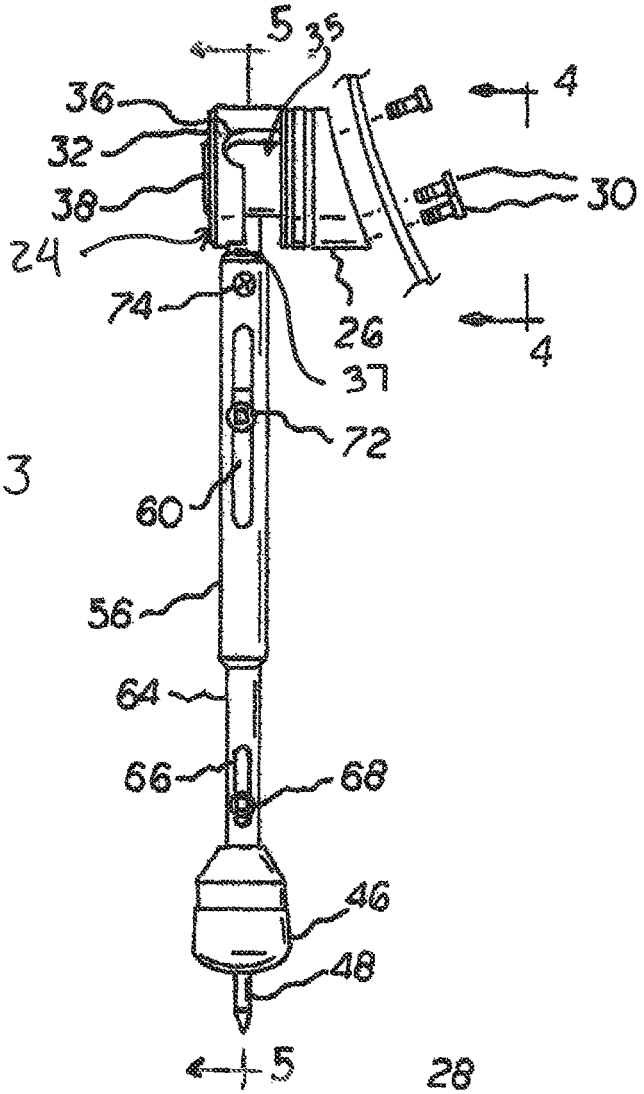
FIG. 3 is an enlarged elevational view taken at line 3-3 of FIG. 2.
Figure 4:
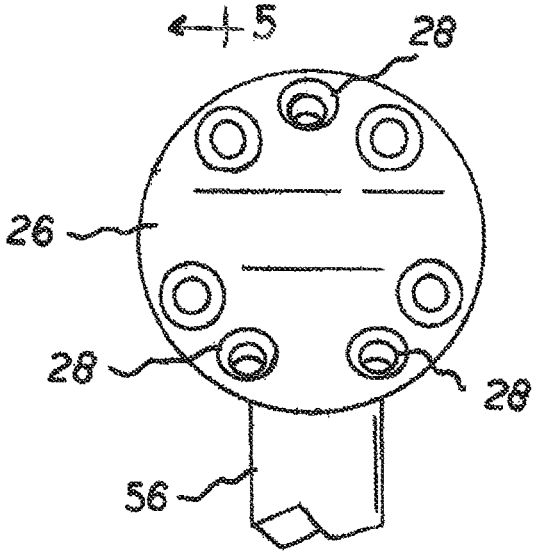
FIG. 4 is a side elevational view taken at line 4-4 of FIG. 3.
Figure 5:
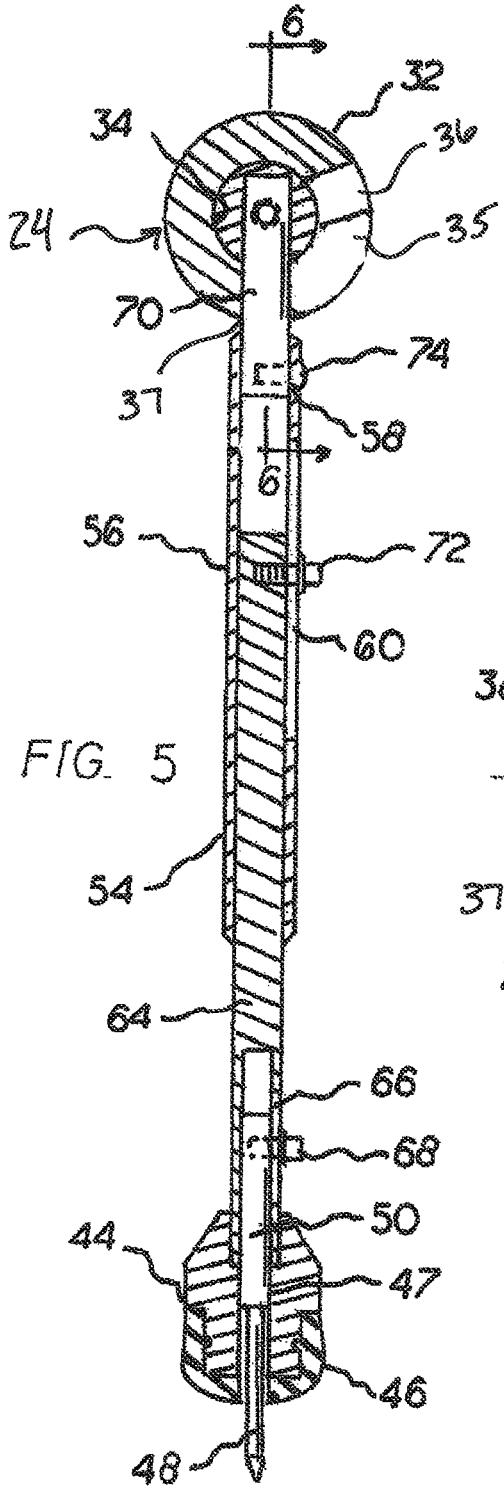
FIG. 5 is a cross-sectional view taken at line 5-5 of FIG. 4.
Figure 6:
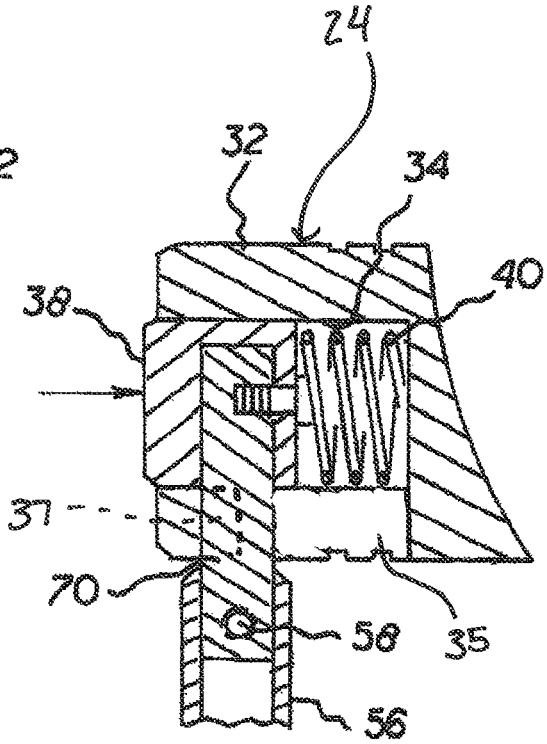
FIG. 6 is a cross-sectional view taken at line 6-6 of FIG. 5.

With reference now to the drawings, and in particular to FIGS. 1-6 thereof, the preferred embodiment of the new and improved bass drum spur system embodying the principles and concepts of the present invention and generally designated by the reference numeral 10 will be described.

The present invention, the bass drum spur system has a plurality of components. Such components are individually configured and correlated with respect to each other to attain the desired objective. In their broadest context, the present invention is bass drum spur system comprising a bass drum having first and second rims with a first and second heads.

Next is a pivot assembly including a spur hub with apertures and with bolts for coupling the spur hub to a rim. The pivot assembly includes a hub cover having a cylindrical passageway formed with a notch. The pivot assembly includes a release button axially slidable within the hub cover. The pivot assembly includes a spring urging the release button away from the spur hub and the first rim.

Provided next is a foot having a foot pad with a central bore. A downwardly extending finger and an upwardly extending projection are positioned within the central bore. Lastly, a spur leg assembly is provided. Such spur leg assembly has a sleeve with a sleeve aperture and with a long axial slot beneath the sleeve aperture. The spur leg assembly has an insert. A recess is formed in a lower end and with a short axial slot. A lower bolt extends through the short axial slot adjustably coupling the spur to the sleeve. The spur leg assembly has a stem. A central bolt extends through the long slot adjustably coupling the stem to the sleeve. An upper bolt couples the button to the stem.

From a specific viewpoint, the present invention is a bass drum spur system 10 for fixedly positioning a bass drum 12 during use and for facilitating the movement of the bass drum when not in use. The positioning and the facilitating are done in a safe, convenient, and economical manner. The system includes the bass drum 12. The bass drum has a vertically oriented first rim 14 with a first head 16 and a vertically oriented second rim 18 with a second head 20. The first and second rims and the first and second drumheads have a common horizontal axis.

Two pivot assemblies 24 are provided with each pivot assembly including a spur hub 26 with a plurality of apertures 28. The apertures having a plurality of bolts 30 for coupling the spur hub to the first rim at opposed locations. Each pivot assembly 24 includes a hub cover 32 with a cylindrical passageway 34 and a circumferential slot 35 formed through the sidewall of the passageway. The circumferential slot 35 is formed with semi-cylindrical notches 36 and 37 at opposite ends of the slot. Each pivot assembly 24 includes a release button 38 axially slidable within the hub cover. Each pivot assembly 24 also includes a coil spring 40 urging the release button away from the spur hub and the first rim.

Provided next are two feet 44, each having an elastomeric foot pad 46. Each foot and the foot pad are vertically oriented with a central bore 47 and with a downwardly extending finger 48 within each central bore. Next, an upwardly extending projection 50 is within each central bore.

Lastly provided are two adjustment assemblies 54. Each spur leg assembly has a sleeve 56 formed as a hollow cylinder with an upper end and a lower end. Each sleeve has a sleeve aperture 58 adjacent to the upper end with a long axial slot 60 beneath the sleeve aperture. Each spur leg assembly has an insert 64 formed as a cylinder with an upper end and a lower end. A recess is formed in the lower end with a short axial slot 66. A lower bolt 68 extends through each short axial slot adjustably coupling a spur to a sleeve.

Each spur leg assembly has a post 70 formed as a cylinder with an upper end and a lower end, the upper end fixedly attached the release button 38. A central bolt 72 extends through the long slot adjustably coupling the post 70 to the sleeve. A bolt 74 couples a button 38 to the post 70 whereby rotation of the spur leg assembly to a raised inoperative position will locate the post in the notch 36 and locate the fingers above a support surface 76 to facilitate moving the drum and whereby the rotation of the adjustment to a lowered operative position will locate the post in notch 37 and locate the fingers in contact with a support surface 76 to facilitating playing the drum.

While the invention herein disclosed has been described by means of specific embodiments and applications thereof, numerous modifications and variations could be made thereto by those skilled in the art without departing from the scope of the invention set forth in the following claims.

What is claimed is:

1. A bass drum spur system comprising:

a pivot assembly, the pivot assembly comprising a spur hub removably attachable to a rim of a drum; a hub cover attached to the spur hub, the hub cover having a passageway and a circumferential slot formed through a sidewall of the passageway, the circumferential slot having first and second notches at respective opposite ends of the slot; a release button axially slidable within the passageway of the hub cover; and a spring disposed in the passageway and biasing the release button in a direction away from the spur hub; and a spur leg assembly, the spur leg assembly having a post fixedly attached to the release button for movement therewith, wherein the post is movable between engagement with the first notch and the second notch by pressing the release button in a direction toward the spur hub and rotating the post along the circumferential slot, wherein the spur leg assembly further has a foot for engagement with a ground surface when the post is disposed in the first semi-cylindrical notch.

2. The bass drum spur system of claim 1, wherein the first and second notches are semi-cylindrical shaped.

3. The bass drum spur system of claim 1, wherein the spur hub has a plurality of apertures for receiving a respective bolt for securing the spur hub to rim.

4. The bass drum spur system of claim 1, wherein the spur hub has a rim contact surface that is curved to complement a curvature of the rim.

5. A bass drum spur system for use with a bass drum having a drum ring, comprising in combination:

a pair of spurs, one spur attached to opposite sides of the drum ring, each spur comprising a pivot assembly and a spur leg assembly;

each pivot assembly comprising a spur hub removably attachable to the rim of the drum; a hub cover attached to the spur hub, the hub cover having a passageway and a circumferential slot formed through a sidewall of the passageway, the circumferential slot having first and second semi-cylindrical notches at respective opposite ends of the slot; a release button axially slidable within the passageway of the hub cover; and a spring disposed in the passageway and biasing the release button in a direction away from the spur hub; and each spur leg assembly having a post fixedly attached to the release button for movement therewith, wherein the post is movable between engagement with the first semi-cylindrical notch and the second semi-cylindrical notch by pressing the release button in a direction toward the spur hub and rotating the post along the circumferential slot, wherein the spur leg assembly further has a foot for engagement with a ground surface when the post is disposed in the first semi-cylindrical notch.

6. The bass drum spur system of claim 5, wherein each spur hub has a plurality of apertures for receiving a respective bolt for securing the spur hub to rim.

7. The bass drum spur system of claim 5, wherein each spur hub has a rim contact surface that is curved to complement a curvature of the rim.

* * * * *